US006294021B1

(12) United States Patent
Platzcke et al.

(10) Patent No.: US 6,294,021 B1
(45) Date of Patent: Sep. 25, 2001

(54) SYSTEM FOR APPLYING QUICK-DRYING COATING AGENTS

(75) Inventors: Martin Platzcke; Jörg Lenz, both of Münster (DE)

(73) Assignee: BASF Coatings AG, Muenster-Hiltrup (DE)

( * ) Notice: Subject to any disclaimer, the term of this patent is extended or adjusted under 35 U.S.C. 154(b) by 0 days.

(21) Appl. No.: 09/269,456

(22) PCT Filed: Sep. 10, 1997

(86) PCT No.: PCT/EP97/04950

§ 371 Date: Mar. 26, 1999

§ 102(e) Date: Mar. 26, 1999

(87) PCT Pub. No.: WO98/13146

PCT Pub. Date: Apr. 2, 1998

(30) Foreign Application Priority Data

Sep. 28, 1996 (DE) ..... 196 40 080

(51) Int. Cl.[7] ..... B43K 8/02

(52) U.S. Cl. ..... 118/270; 401/23; 401/202; 401/205

(58) Field of Search ..... 118/264, 266, 118/270; 401/23, 202, 205

(56) References Cited

U.S. PATENT DOCUMENTS 4,652,163 3/1987 Karliner et al. ..... 401/195
4,818,134 * 4/1989 Tsai ..... 401/195
4,983,061 * 1/1991 Demarest ..... 401/148
5,316,403 * 5/1994 Mansour ..... 401/207
5,480,680 1/1996 Vieyra ..... 427/388.4
5,881,876 * 3/1999 Nonomura et al. ..... 206/361
5,897,262 * 4/1999 Bratby-Carey ..... 401/18
5,927,880 * 7/1999 Allison et al. ..... 401/17

FOREIGN PATENT DOCUMENTS 35 31 661 C1 9/1985 (EP) ..... B05D/1/28

OTHER PUBLICATIONS

HomeRight Stain Stick applicator, web page from shop.cornerhardware.com, visited Jan. 26, 2001.

HomeRight Stain stick applicator, enlarged image from shop.cornerhardware.com, visited Jan. 26, 2001.

* cited by examiner

*Primary Examiner*—James Sells

(57) ABSTRACT

The invention relates to a system for the application of quick-drying coating compositions, where the system contains of [sic] a plastic container having a pressure release valve and containing the coating composition, of [sic] a sponge having a planar application surface and having a pore structure, connected by capillaries and open at the application surface, which sponge embeds the pressure release valve, and of [sic] a lid for airtight sealing of the sponge when the system is not being used.

8 Claims, 2 Drawing Sheets

SYSTEM FOR APPLYING QUICK-DRYING COATING AGENTS

BACKGROUND OF THE INVENTION

1. Field of the Invention

The invention relates to a system comprising a quick-drying, preferably aqueous, coating composition, the system consisting of a plastic container having a pressure release valve and containing the aqueous coating composition, a sponge for applying the aqueous coating composition, and a lid for airtight sealing of the sponge.

2. Prior art

Quick-drying coating compositions are known. Such coating compositions, which are preferably aqueous, are employed in particular in the first-time coating and in the care of wooden components, the coating compositions used as wood varnishes preferably comprising air-drying alkyd resins as binders.

In accordance with the processes of the prior art such wood varnishes are applied, for example, by brush or roller coating or by spray gun. These application techniques are disadvantageous in that in the case of brush or roller coating, especially of wooden frames or wooden profiles (for example window frames or treads), the substrate requires laborious preparation, that it is necessary to mask off the areas which are not to be varnished, that the wood varnishes tend toward dripping during application, that the wood varnishes form a skin in the storage vessels as a result of air contact on the liquid surface, and that the cleaning [sic] tools have to be cleaned with organic solvents, in an environmentally detrimental manner.

When using spray guns, the surfaces which are not to be varnished must likewise be masked off. In addition, following the application of the wood varnish, the spray nozzles of the spray guns require thorough cleaning in order to avoid them becoming blocked by dried-on varnish residues.

In all of the processes mentioned there are losses of coating composition as a result, for example, of dripping, paint splashes, overspray in the case of spray guns, or cleaning of the application tools.

SUMMARY OF THE INVENTION

The prior art threw up the problem of providing a system for the application of quick-drying coating compositions, especially wood varnishes, in which ease of handling, the avoidance of dripping in the course of varnish application, the avoidance of skinning in the storage vessel, and the avoidance of the drying-on of the varnish on the brush, on the roller or on the nozzle of the spray gun, are ensured.

The intention was at the same time to ensure uniform film application even in the case of relatively large areas, the avoidance of the impoverishment of the quick-drying aqueous coating composition at the application surface, the minimization of the application-related losses of coating composition, and the avoidance of the need to mask off areas which are not to be varnished.

Surprisingly, the novel system described below meets these requirements.

It consists essentially of a single-use or refillable plastic container having a pressure release valve and containing the quick-drying coating composition, of a sponge, which embeds the pressure release valve and is preferably in contact with it, by means of which sponge the quick-drying aqueous coating composition is distributed on the substrate that is to be coated, and of a lid, which provides an airtight seal to the sponge when the latter is not being used. In the course of application of the quick-drying coating composition, the sponge is pressed onto the surface that is to be coated and thereby actuates the pressure release valve, which dispenses the coating composition into the sponge. Here, the coating composition penetrates the cavities of the sponge, which are connected in a capillarylike manner, in such a way that there is always approximately the same amount of coating composition available at the surface of the sponge with which the coating composition is applied.

Since the sponge itself represents a comparatively large reservoir for the coating composition, which reservoir is continuous supplied with fresh coating composition by way of the pressure release valve, the coating composition can be applied in a uniform film thickness to relatively large substrate areas without dripping.

Reducing the pressure on the sponge and thus on the pressure release valve interrupts the supply of fresh coating composition to the sponge. This simple and economic metering facility creates a temporal window for optimum distribution of the coating composition on the substrate.

Furthermore, the drying of the coating composition on the pressure release valve and in the sponge is prevented by the continuous resupply of fresh coating composition by way of the pressure release valve, which is controlled by means of the pressure on the sponge, and by simultaneous continuous consumption of coating composition at the sponge surface.

It is no longer necessary to mask off the substrate surface that is to be coated [sic] since the sponge allows precise, locally restricted application of the coating composition.

DETAILED DESCRIPTION OF THE INVENTION

The Quick-drying Coating Compositions

Figure 1:
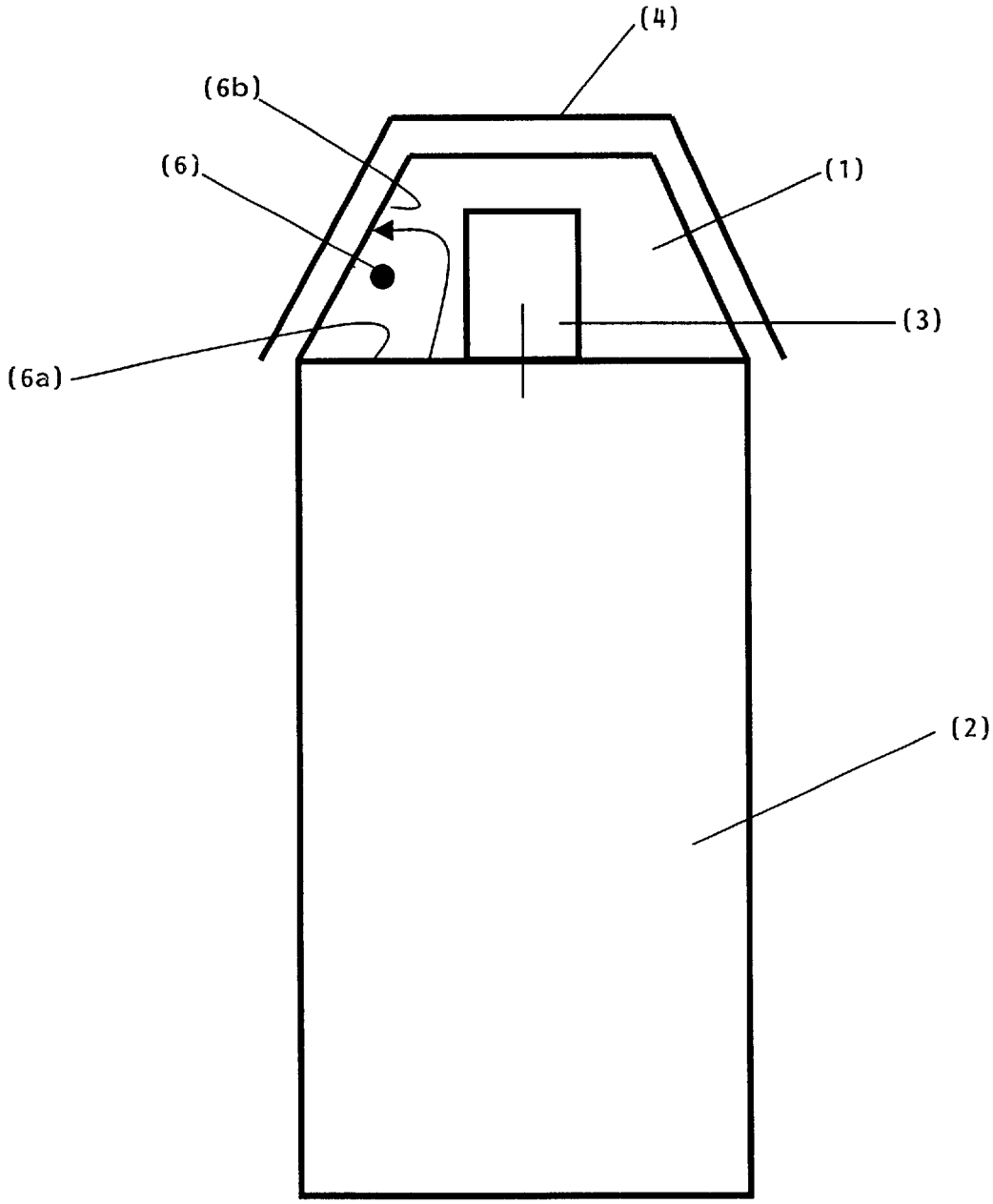
FIG. 1 is a side cut away view of the system of the invention.

The quick-drying, preferably aqueous coating compositions which can be applied with the novel system are preferably water-thinnable varnishes based on alkyd resin having a solids content of up to 30% by weight, preferably up to 25% by weight, based on the varnish. As solid components the varnish comprises essentially alkyd resins or alkyd resin derivatives as binders, pigments and/or fillers, and further coating auxiliaries, for example leveling assistants and/or rheological assistants.

The binders, which generally make up a proportion of from 0.1 to 25% by weight, preferably from 1 to 20% by weight, based on the coating composition, are essentially alkyd resins or derivatives thereof, such as polyester-alkyd resins, polyurethane-alkyd resins or polyacrylate-alkyd resins, for example.

As examples of pigments and/or fillers there may be mentioned: titanium dioxide, iron oxide pigments, especially transparent iron oxides, carbon blacks, silicon dioxide, aluminum silicate, lead compounds and chromate compounds, barium sulfate, mica, talc, kaolin or chalk.

As auxiliaries the varnish may also comprise, for example, rheology-controlling agents or associative thickeners. In addition to the binder, the pigments and/or fillers and the auxiliaries, the control colors comprise water-thinnable solvents, for example various esters, such as ethyl acetate, butyl acetate, ethyl glycol acetate, butyl glycol acetate, ethyl glycol diacetate and the like, for example, or lower alcohols which are possibly alkoxylated.

The System Comprising Plastic Container, Sponge and Lid and the Application of the Quick-drying Coating Composition The plastic container with pressure release valve manages to convey, and to impregnate the sponge with, the quick-drying coating composition without propellants. Such plastic containers with a pressure release valve are based essentially on gravimetic [sic] (hydrostatic) conveyance of the coating composition and on distribution of the liquid through the pressure release valve under autogenous pressure. Similar plastic containers with pressure release valve are employed, with a modified application system, in the application of cosmetics.

The sponge used for applying the quick-drying coating composition embeds the pressure release valve and is preferably in direct contact with it.

The sponge material is preferably corrosion-resistant in relation to the solvents which are present in the coating composition and/or in relation to water. The sponge is of a form such that it is substantially planar in construction at the application surface and such that it has a pore structure, connected by capillaries, which is open at the application surface. The application surface area of the sponge is, for example, between 1 and 200 square centimeters, preferably between 2 and 100 square centimeters, with a sponge volume of between 1 and 500 cubic centimeters, preferably between 2 and 200 cubic centimeters.

The pore structure of the sponge consists preferably of pores of approximately equal size, for example in the pore size range between 0.1 and 100 cubic millimeters, preferably between 0.5 and 50 cubic millimeters. The pores of the sponge are interconnected by capillaries which ensure liquid exchange between the pores. These capillaries which connect the pores of the sponge ensure an approximately constant concentration of the coating composition at the surface of the sponge, in the course of application of the quick-drying coating composition, by means of a controlled, permanent supply of the coating composition from the interior of the sponge. This supply process is triggered by slight manual pressure on the sponge and thus by the simultaneous actuation of the pressure release valve and the supply of coating composition from the plastic container.

The sponge can possess various geometric forms, which can be characterized by the cross-sectional area of the sponge perpendicular to the cross-sectional area of the plastic container: for example, the cross-sectional area of the sponge can be square or rectangular, preferably trapeziform, with the base of the trapezium pointing toward the plastic container and the tip of the trapezium pointing away from the plastic container, and can with particular preference be triangular, the base of the triangle again pointing toward the plastic container and the tip of the triangle again pointing away from the plastic container. The cross-sectional area of the sponge parallel to the cross-sectional area of the plastic container is preferably circular.

Consequently, the preferred three-dimensional form of the sponge in the case of the square or rectangular cross-sectional areas perpendicular to the cross-sectional area of the plastic container is a cylinder. In the preferred cases of the trapeziform and, in particular, of the triangular cross-sectional area perpendicular to the cross-sectional area of the plastic container, the three-dimensional form of the sponge which results is a cylinder having two sections which are each at an angle of less than 90 degrees to the cross-sectional area of the plastic container. The sections are preferably arranged such that the base and the arms of the triangle or trapezium which forms the cross section form angles of between 15 and 75 degrees, preferably between 30 and 60 degrees.

In connection with the application of the quick-drying coating composition, the pressing of the sponge onto the substrate surface that is to be coated actuates the pressure release valve of the plastic container, which dispenses the coating composition to the sponge. Initially occurring gradients in the concentration of the coating composition in the interior of the sponge and, in particular, at the sponge surface are compensated comparatively rapidly and extensively by the capillary structure of the sponge. At the same time, the capillary structure of the sponge prevents too quick an evaporation of the solvent component of the coating composition and of the aqueous component in the case of an aqueous coating composition, and thus suppresses the formation of a film of the coating composition on the sponge surface and in the sponge interior.

After the sponge has been impregnated in this way with the quick-drying coating composition, the coating composition is applied to the substrate that is to be coated. In this process the coating composition is released uniformly from the sponge, thereby ensuring application of the coating composition with a uniform film thickness. In order to prevent paucity of the coating composition at the sponge surface, a small constant pressure is preferably exerted on the sponge in the course of application. With the novel system comprising plastic container and sponge, especially with a sponge of the preferred trapeziform or triangular sponge cross-sectional geometry, which system allows the plastic container to sit like a pen in the hand when the coating composition is being applied; therefore, two-dimensionally accurate manual application of the quick-drying coating composition with constant film thicknesses becomes possible, with avoidance of the abovementioned disadvantages of the masking off of areas not to be coated, of dripping, of drying and of skinning in the storage vessel containing the coating composition.

Another feature essential to the invention is that, when the novel system is not being used, the sponge is sealed off in an airtight manner by means of a lid which prevents the drying of the quick-drying aqueous coating composition. The dimensions of the lid are preferably such that, with an airtight closure of the sponge, the remaining free volume within the lid is such that the amount of solvent and/or, if present, water which can evaporate from the sponge into the free volume is only such that the coating composition remaining in the sponge does not dry within the capillaries of [bhm] the sponge before the next application. With particular preference, the free volume within the lid is not more than 100% of the sponge volume.

The combination of coating composition, plastic container containing the coating composition, sponge as application tool, and lid is of particular practical utility. On the one hand, the sponge acts together with the pressure release valve as a closure for the plastic container and prevents the drying of the coating composition within the plastic container. On the other hand, the sponge is sealed in an airtight manner by the lid and is thus protected against drying, thereby avoiding the tool cleaning necessary in the prior art processes.

Figure 2:
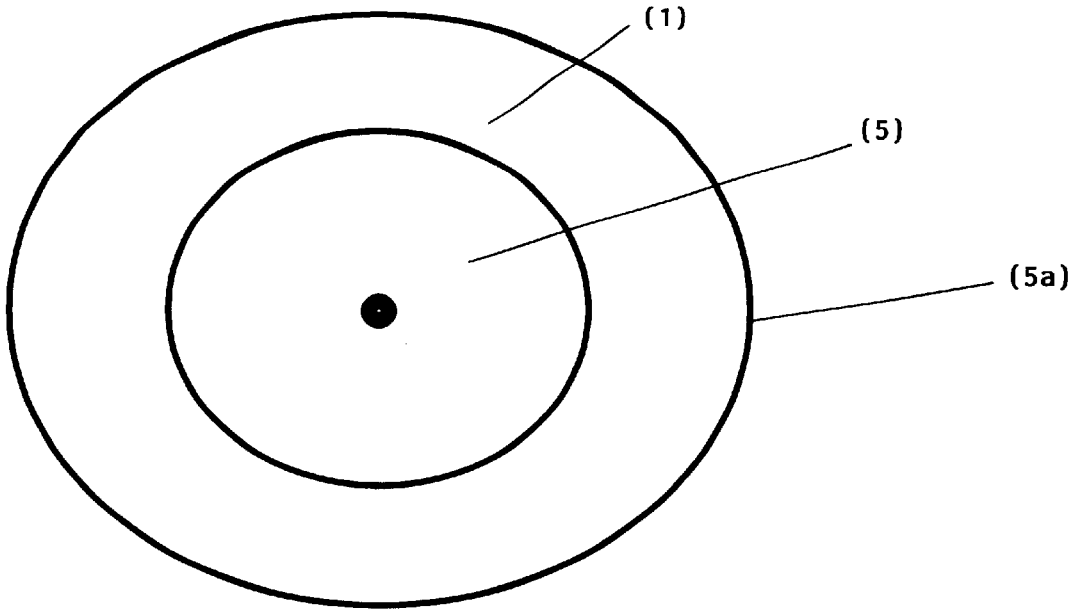
FIG. 2 is a side view from the top of the embodiment of FIG. 1.

The foregoing aspects of the invention are illustrated in FIGS. 1 and 2. FIG. 1 shows a cut away side view of the system of the invention. FIG. 1 has a sponge (1) having a trapezoid cross section and a plastic container (2). Embedded in sponge (1) is pressure release valve (3). (6) is the angle between the base (6*a*) and arm (6*b*) of the trapezoid cross section of sponge (1). Lid (4) fits over sponge (1). FIG. 2 provides a view from the top of the embodiment of FIG. 1. (5) and (5*a*) illustrate the circular cross sectional area <T> parallel to the cross sectional area of plastic container (2).

What is claimed is:

1. A system for applying a quick-drying coating composition, comprising:

a plastic container containing a coating composition and having a pressure release valve;

a sponge having a planar application surface and a pore structure, connected by capillaries and open at the planar application surface, wherein the sponge embeds the pressure release valve; and a lid for airtight sealing of the sponge when the system is not being used, wherein the coating composition comprises a water-based coating with an alkyd resin as a binder.

2. The system of claim 1, characterized in that the sponge is in direct contact with the pressure release valve.

3. The system of claim 1, characterized in that the sponge is corrosion-resistant in relation to the solvents which are present in the coating composition and/or in relation to water.

4. The system of claim 1, characterized in that the sponge possesses very substantially size-homogeneous pores having pore volumes of between 1 and 500 cubic millimeters.

5. The system of claim 1, characterized in that the sponge has a trapeziform or triangular cross-sectional area perpendicular to the cross-sectional area of the plastic container.

6. The system of claim 1, characterized in that the sponge has a circular cross-sectional area parallel to the cross-sectional area of the plastic container.

7. The system of claim 5, characterized in that the base and the arms of the triangle or trapezium which forms the cross section of the sponge perpendicular to the cross-sectional area of the plastic container form angles of between 15 and 75 degrees.

8. The system of claim 1, characterized in that, with an airtight closure of the sponge with the lid, the remaining free volume within the lid is such that the amount of solvent and/or water which can evaporate from the sponge into the free volume is only such that the coating composition remaining in the sponge does not dry within the capillaries of the sponge before the next application.

* * * * *